US011760552B2

(12) United States Patent
Roberts et al.

(10) Patent No.: US 11,760,552 B2
(45) Date of Patent: Sep. 19, 2023

(54) PERSONAL HYGIENE KIT

(71) Applicants: Stanley Roberts, Loganville, GA (US); Jamie Edwards, Norcross, GA (US)

(72) Inventors: Stanley Roberts, Loganville, GA (US); Jamie Edwards, Norcross, GA (US)

( * ) Notice: Subject to any disclaimer, the term of this patent is extended or adjusted under 35 U.S.C. 154(b) by 0 days.

(21) Appl. No.: 17/034,113

(22) Filed: Sep. 28, 2020

(65) Prior Publication Data

US 2022/0097944 A1 Mar. 31, 2022

(51) Int. Cl.

| | |
|---|---|
| ***B65D 81/00*** | (2006.01) |
| ***B65D 85/67*** | (2006.01) |
| ***B65D 77/00*** | (2006.01) |

(52) U.S. Cl.

CPC ..... *B65D 81/00* (2013.01); *B65D 77/00* (2013.01); *B65D 85/67* (2013.01)

(58) Field of Classification Search

CPC ..... B65D 77/00; B65D 81/00; B65D 81/36; B65D 85/67; B65D 85/671

USPC ..... 206/229, 581

See application file for complete search history.

(56) References Cited

U.S. PATENT DOCUMENTS

| | | | | |
|---|---|---|---|---|
| 2,440,974 A * | 5/1948 | Resch | A47K 10/32 | 242/598.6 |
| 2,985,289 A * | 5/1961 | Ren | A47K 7/00 | 206/229 |
| 5,035,321 A * | 7/1991 | Denton | A47L 13/51 | 206/225 |
| 5,909,832 A * | 6/1999 | French | B60S 1/66 | 224/547 |
| 6,135,276 A * | 10/2000 | French | A47L 13/51 | 206/225 |
| 8,517,171 B1 * | 8/2013 | Delgado | B65D 21/0231 | 206/38.1 |
| 10,548,438 B2 * | 2/2020 | Dunn | A47K 10/32 | |
| 2015/0265126 A1 * | 9/2015 | Brown | A47L 25/00 | 134/6 |

* cited by examiner

*Primary Examiner* — Bryon P Gehman

(74) *Attorney, Agent, or Firm* — Ronald Baker, Esq.; BAKER & CO. LAW GROUP

(57) ABSTRACT

The present invention is a portable apparatus for conveniently sanitizing objects. In particular, the invention allows a user to uniquely carry and utilize a convenient kit that stores sanitizing material in an easy manner. The proposed embodiment provides a unique experience for a user by providing a pleasant and secure experience.

12 Claims, 5 Drawing Sheets

PERSONAL HYGIENE KIT

CROSS-REFERENCE TO RELATED APPLICATIONS

None.

BACKGROUND OF THE INVENTION

Field of the Art

The disclosure relates to an apparatus for carrying safety contamination items, and more particularly the invention is an apparatus that provides a convenient multifaceted device for performing daily tasks safely. The embodiment allows a user to disinfect themselves and objects to mitigate the spread of bodily fluid particulates that may transmit pathogens.

Discussion of the State of the Art

Commercial facilities include places such as grocery stores, airlines, casinos, food prep areas (restaurants), and malls that allow the general public to shop but are now considered high risk for health concerns due to potential exposure to pathogenic microbes. Thousands of individuals who may be suffering from domestic and foreign illnesses congregate in these areas. Most large metropolitan areas in the U.S. include a significant amount of the public shopping at grocery stores throughout the week and especially during the weekend. Historically, these venues have become more communal with people socializing around coffee bars, deli display cases and the like. U.S. News & World Report stated that a typical grocery cart handle could be home to 11 million microorganisms, including some from raw meat. What is even more concerning is public schools and colleges and the threat exposure to deadly viruses can have on kids and young adults. The proposed embodiment is further ideal because its ultimate purpose is to allow for an easy sanitizing process to protect the environment in a manner that will be a welcoming change for the general public.

SUMMARY OF THE INVENTION

Accordingly, the inventor has conceived, in a preferred embodiment of the invention, a portable apparatus for conveniently providing a method for users to sanitize their person and surrounding objects. According to a preferred embodiment of the invention, is an apparatus that is designed to store critical items that will allow the user to mitigate the spread of viruses on surfaces. What is further disclosed is a novel apparatus for transporting sanitation items while performing other activities throughout the day. What is further disclosed is a portable container that can be attached to a user's clothing to provide a unique way for a user to easily access disinfectant items while exposed to environmental pathogens. The portability and access is a key component of the invention in that it greatly increases the ability of the user to disinfect their surroundings while performing other tasks.

BRIEF DESCRIPTION OF THE DRAWING FIGURES

The accompanying drawings illustrate several embodiments of the invention and, together with the description, serve to explain the principles of the invention according to the embodiments. It will be appreciated by one skilled in the art that the particular embodiments illustrated in the drawings are merely exemplary and are not to be considered as limiting of the scope of the invention or the claims herein in any way.

DETAILED DESCRIPTION

Figure 1:
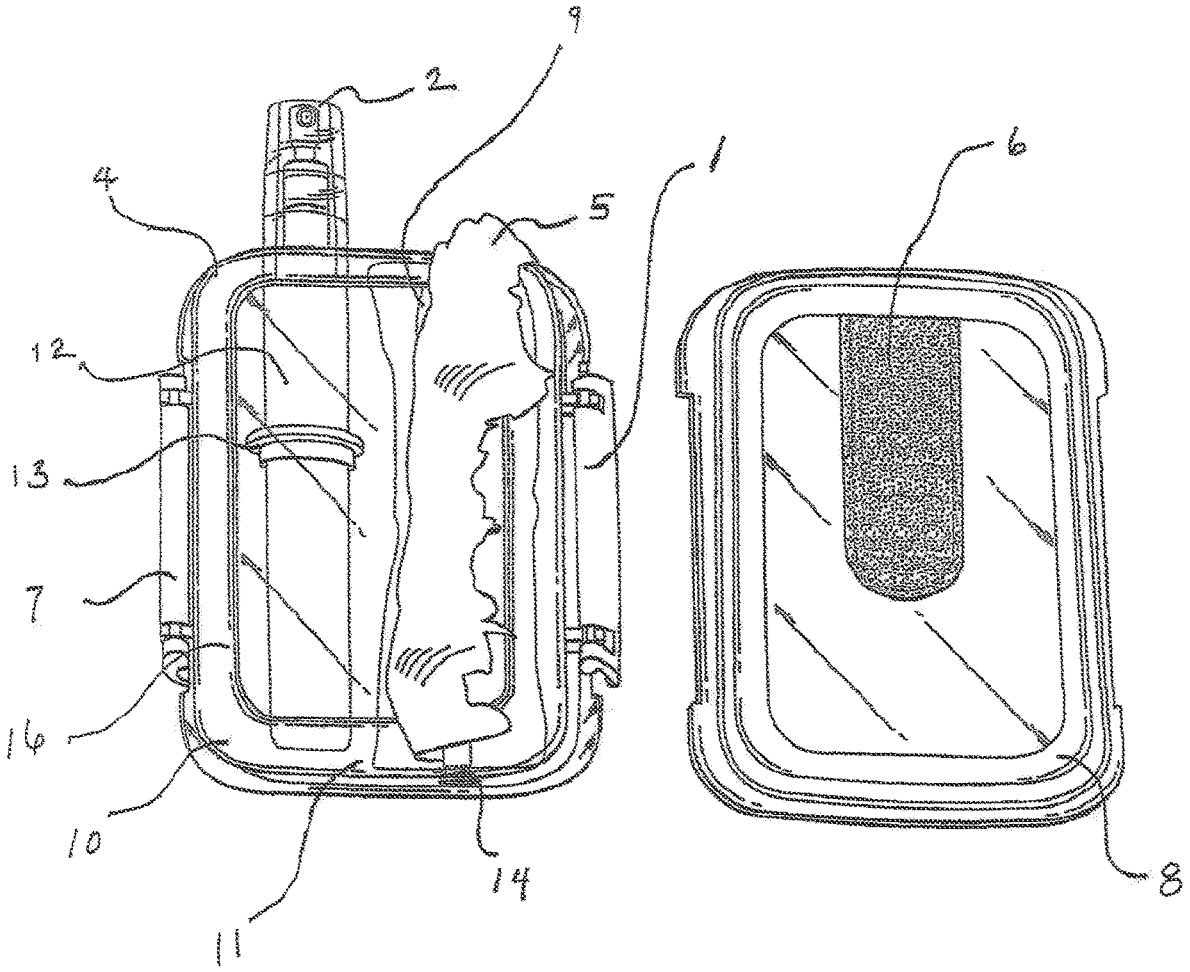
FIG. 1 is a perspective view of a portable apparatus for conveniently disinfecting personal and foreign items, according to a preferred embodiment of the invention.

The inventor has conceived, a novel apparatus for storing and transporting disinfectant material and the like in a convenient manner.

The terms "a" or "an", as used herein, are defined as one, or more than one. The term "plurality", as used herein, is defined as two, or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an exemplary embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

Reference throughout this document to "refillable dispensing bottle", "spray bottle", "bottle" or similar terms refers to a canister that is attached to the inner compartment of the apparatus that is positioned vertically along the inner compartment of the apparatus. Thus, the appearances of such phrases or in various places throughout this specification are not necessarily all referring to the same embodiment. Furthermore, the particular features, structures, or characteristics may be combined in any suitable manner in one or more embodiments without limitation.

Reference throughout this document to "nozzle dispenser", "dispenser", nozzle or similar terms refers to the mechanism of the embodiment that is along the upper external portion of the apparatus. The nozzle is considered the activation mechanism that is attached to the dispensing bottle to allow disinfectant solution to be dispersed by applying direct force to the nozzle. It is important to point out that the user can unscrew the nozzle from the dispensing bottle when refills are necessary. Thus, the appearances of such phrases or in various places throughout this specification are not necessarily all referring to the same embodiment. Furthermore, the particular features, structures, or characteristics may be combined in any suitable manner in one or more embodiments without limitation.

Reference throughout this document to "spool of tissue", "tissue napkin", "tissue" or similar terms refers to tissue that is dispensed from the apparatus for disinfectant purposes. The tissue is utilized by a user to collect disinfectant via nozzle prior to wiping personal or foreign surfaces. Thus, the appearances of such phrases or in various places throughout this specification are not necessarily all referring to the same embodiment. Furthermore, the particular features, structures, or characteristics may be combined in any suitable manner in one or more embodiments without limitation.

One or more different inventions may be described in the present application. Further, for one or more of the inventions described herein, numerous alternative embodiments may be described; it should be appreciated that these are presented for illustrative purposes only and are not limiting of the invention contained herein or the claims presented herein in any way. One or more of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and that structural changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only and are not to be taken as limiting the disclosure in any way.

A description of an embodiment with several components in connection with each other does not imply that all such components are required. To the contrary, a variety of optional components may be described to illustrate a wide variety of possible embodiments of one or more of the inventions and in order to more fully illustrate one or more aspects of the inventions.

Materials described or referenced herein will sometimes be described in singular form for clarity. However, it should be appreciated that particular embodiments may include multiple instantiations of a material unless noted otherwise. Layers in some embodiments can be understood as representing segments or portions of those embodiments. Alternate implementations are included within the scope of embodiments of the present invention would be understood by those having ordinary skill in the art.

In an embodiment, the Personal Hygiene Kit is designed to provide a unique and novel manner for a user to disinfect their immediate surroundings and person in a convenient manner. The apparatus is designed with a body (4) of durable material that can be designed to attach to a user's belt or other articles of clothing by way of a belt clip (6). Where there is a high likelihood of pathogens, it should be appreciated that the apparatus will be designed to provide a user the convenience of traveling throughout the day with essentials such as sanitizer and a spool of tissue napkin (5). In essence, the user will be able to extract a piece of tissue napkin (5) and apply sanitizer by utilizing a nozzle (2) that extends from the top portion of the body (4). Once the apparatus is positioned on a user's clothing by utilizing the belt clip (6), then the user will be able to conveniently use the apparatus while carrying out daily tasks.

In an embodiment, the embodiment is a portable kit that a person may use for disinfecting various objects in a convenient manner. The apparatus is comprised of a body (4) that is shaped with a rectangular exterior, a rear door (8), orifice (3), clasp (7), hinge (1), and belt clip (6). The apparatus is also designed to insert a refillable dispensing bottle (12) that can be removed and refilled with sanitizer at the user's discretion by removing the nozzle (2), and a spool of tissue (6) along the inner compartment (11) of the apparatus. The inner compartment (11) surface of the apparatus includes an orifice (3) that is utilized to insert the nozzle (2) as well as a first rivet (14) and second rivet (15) to receive a spool of tissue napkin (5). Once the apparatus has been securely attached to the user's belt, the tissue napkin (5) can be extracted by pulling on the sheets thus allowing the tissue napkin (5) to separate at which point the user can apply the sanitizer on the tissue napkin (5). In a non-limiting example, the sanitizer can also be applied on a user's hands or other objects by spraying sanitizer directly to the designated area without the use of the tissue napkin (5). It will be appreciated that the apparatus can be made in various colors to satisfy a discriminate user. As an example, stylish teenagers may find it appealing to purchase the apparatus in different colors to potentially match their clothing attire. As an optional embodiment, it should be appreciated that the apparatus is ideal for those who are handicapped. To elaborate, the apparatus can be designed to clip to a wheel chair and allow a physically challenged person to conveniently utilize the apparatus without much difficulty. This concept will provide a sense of security and mobility to individuals who have found it difficult to perform tasks without the heightened risk of viral contamination.

In an exemplary embodiment, the user will simply extract the tissue napkin (5) with one hand while subsequently holding the tissue flat and depressing the nozzle (2) with the opposite hand to apply sanitizer directly to an infected area or the tissue napkin (5). It will be appreciated that as a non-limiting alternative the apparatus can also accommodate layers of sanitized tissue napkins that can be placed flat in the inner compartment (11) without the use of a spool. This will allow users the added option when refiling the apparatus with tissue napkins.

Exemplary Embodiments

FIG. 1 is a perspective view of an apparatus for conveniently sanitizing objects to include a perspective view of the front compartment (16) and the rear door (8), according to a preferred embodiment of the invention. According to the embodiment a sanitizing apparatus comprises a body (4), a nozzle (2) that is positioned along the top portion of the body (4), a front compartment (16) of the body (4), an inner compartment surface (11) for storing the spool of tissue napkin (5) and a refillable dispensing bottle (12) conveniently located along the inner compartment (11). The inner compartment (11) also includes a clamp (13) to securely hold the refillable dispensing bottle (12). A belt clip (6) is designed along the rear door (8) of the apparatus to allow the apparatus to be attached on a user's clothing via the belt clip (6). The schematic includes a hinge (1) attached to one edge of said rear door (8) that can be securely closed by a clasp (7). The issue napkin (5) is held in place by a first rivet (14) and second rivet (15) (not shown). The front surface (10) of the apparatus includes a slit (9) that extends from the lower edge of the body to the top portion of the body (4). The issue napkin (5) extends through the slit (9) to allow the user to dispense the tissue for use.

Figure 2:
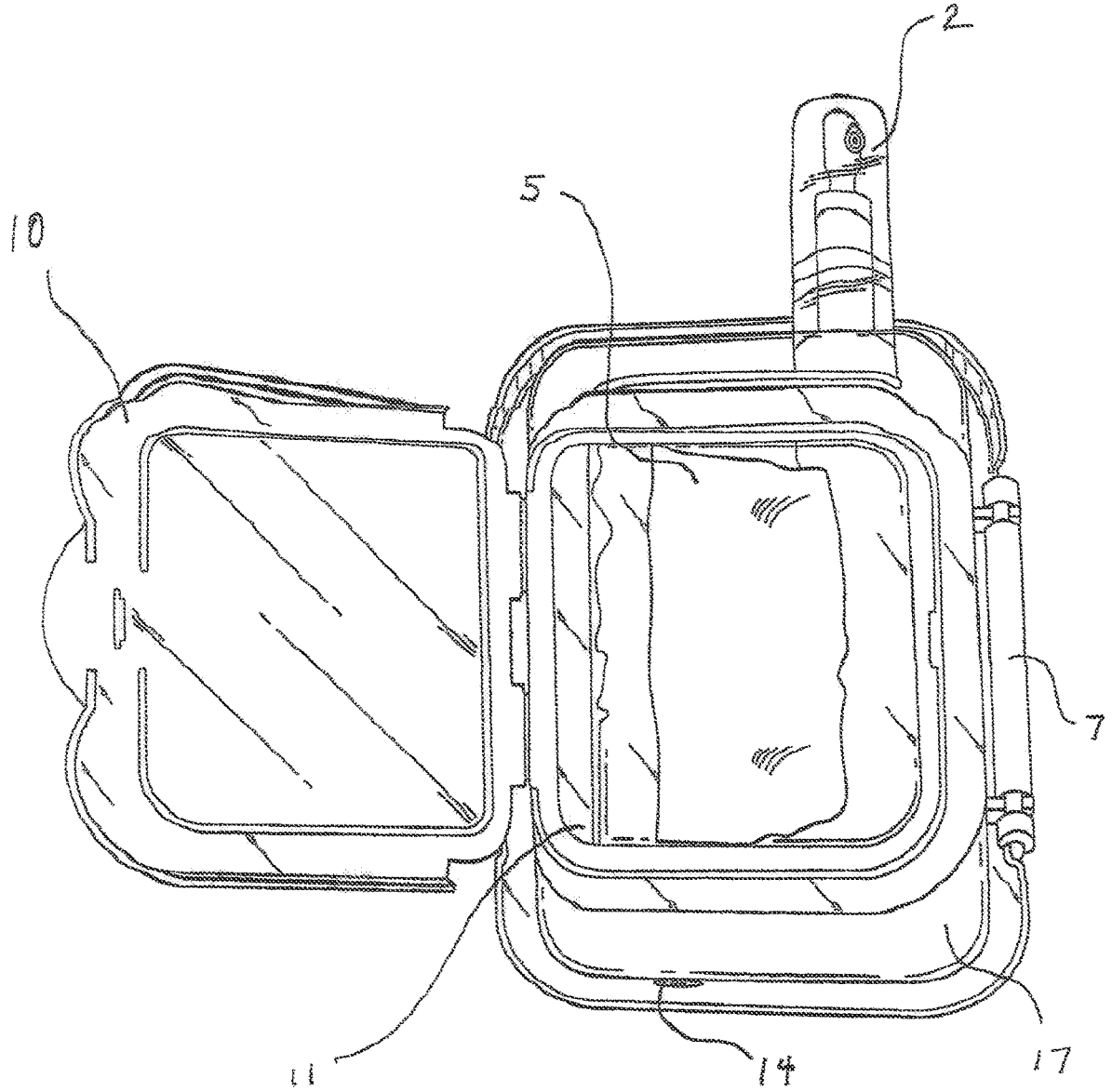
FIG. 2 is a rear view of a portable apparatus for conveniently disinfecting personal and foreign items, according to a preferred embodiment of the invention.

FIG. 2 is a rear view of an apparatus for conveniently sanitizing objects, according to a preferred embodiment of the invention. According to the embodiment has a rear door (8) that when closed is held secure by the clasp (7). The depiction also shows a nozzle (2) for dispensing the sanitizer and a rear compartment (17) of the apparatus. The spool of tissue napkin (5) is attached to the inner compartment (11) by a first rivet (14) and second rivet (15) (not shown).

Figure 3:
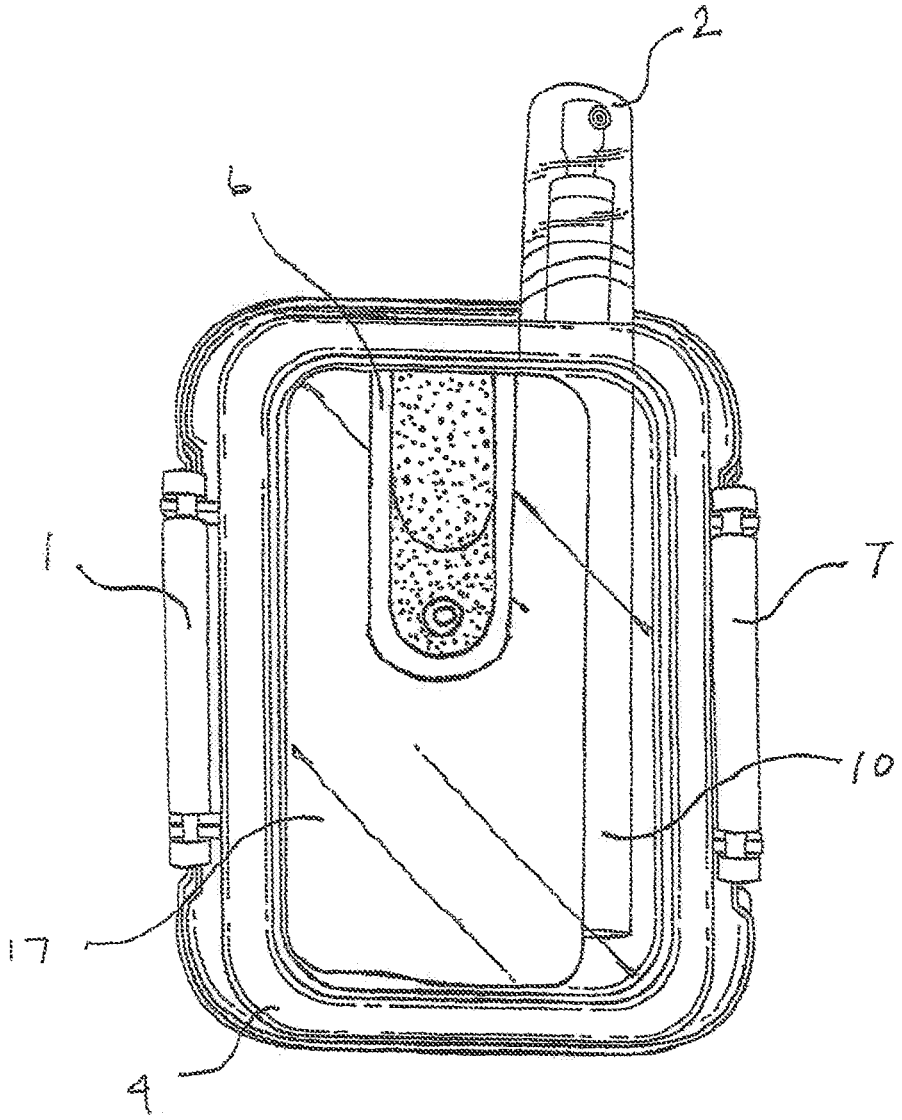
FIG. 3 is a rear view of a portable apparatus for conveniently disinfecting personal and foreign items, according to a preferred embodiment of the invention.

FIG. 3 is a perspective rear view of an apparatus for conveniently sanitizing objects, according to a preferred embodiment of the invention. According to the embodiment, the rear door (8) is hingedly (1) closed securely by the clasp (7). The depiction shows a nozzle (2) for dispensing sanitizer positioned along the top of the body (4). The schematic also shows the belt clip (6) affixed to the outer surface the rear door along the rear compartment (17).

Figure 4:
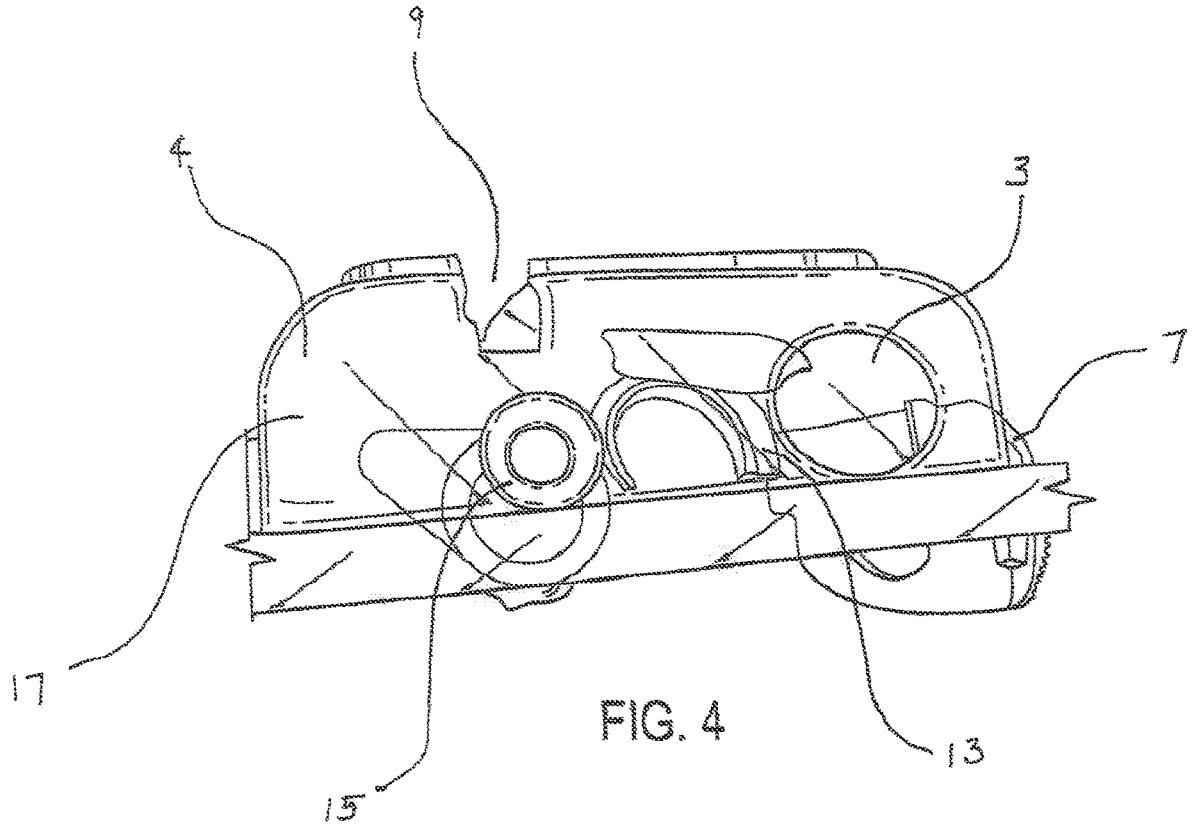
FIG. 4 is a top view of a portable apparatus for conveniently disinfecting personal and foreign items, according to a preferred embodiment of the invention.

FIG. 4 is a top view of an apparatus for conveniently sanitizing objects, according to a preferred embodiment of the invention. According to the embodiment, the rectangular shaped body (4) has a clasp (7), and slit (9) that extends vertically along the rear compartment (17) of the body (4). The slit (9) is ideal for extracting the tissue napkin (not shown). The depiction also shows an orifice (3) along the top edge for inserting the nozzle (not shown). Additionally, there is also a clamp (13) for holding the refillable dispensing bottle (not shown). The spool of tissue napkin (not shown) fits securely in the first rivet (14) (not shown) and second rivet (15) when assembled to allow the spool of tissue napkin (not shown) to rotate when in use.

Figure 5:
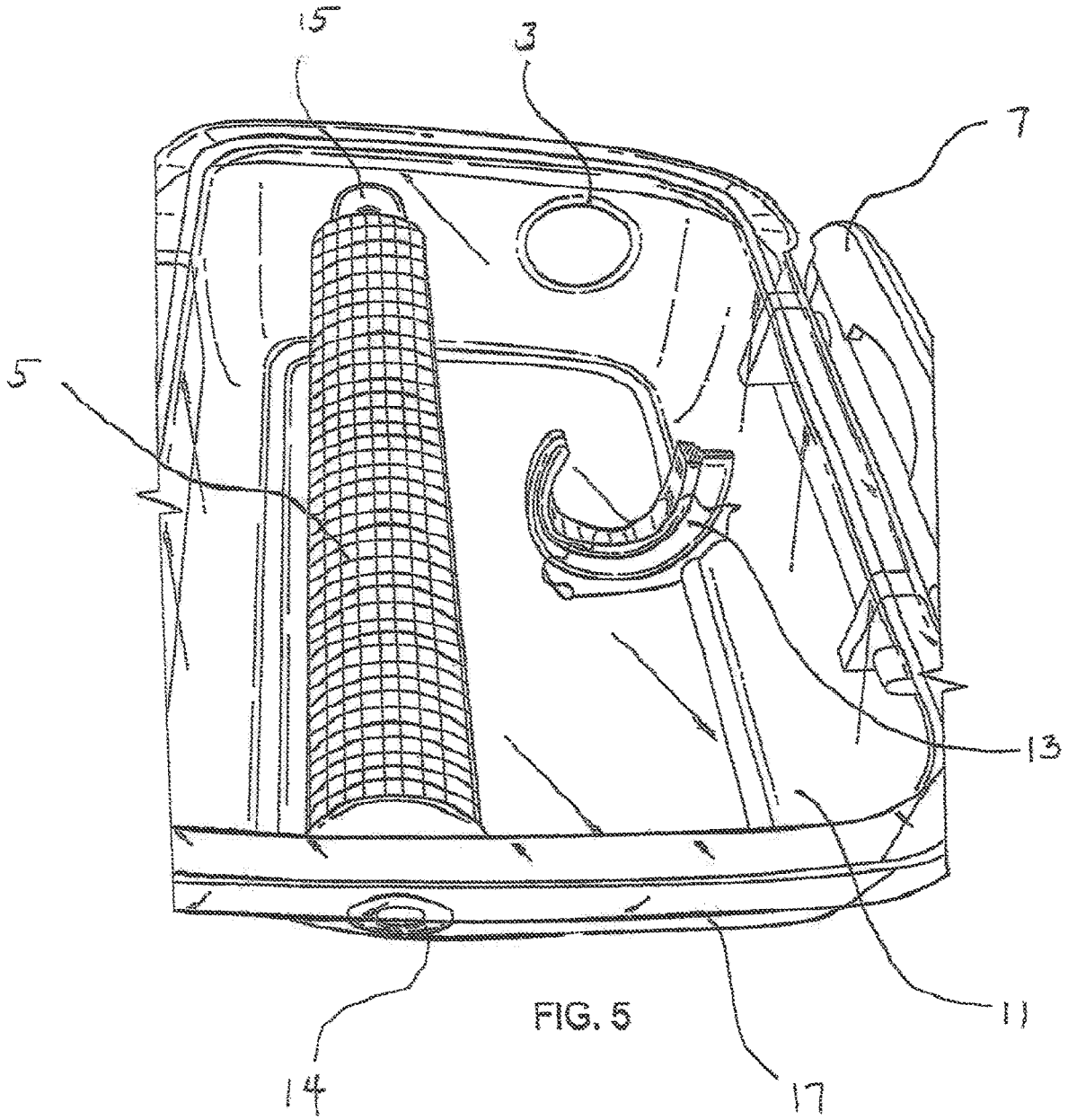
FIG. 5 is a perspective view depicting the inner compartment of a portable apparatus for conveniently disinfecting personal and foreign items, according to a preferred embodiment of the invention.

FIG. 5 is a perspective view of the inner compartment of an apparatus for conveniently sanitizing objects, according to a preferred embodiment of the invention. According to the embodiment, the inner compartment (11) shows a spool of tissue napkin (5) applied to the inner compartment (11) by use of the first rivet (14) and second rivet (15). The depiction also shows a clamp (13) which is useful for holding the dispensing bottle (not shown) securely in place. The depiction also shows the rear compartment (17), an orifice (3) for inserting the nozzle (not shown) and a clasp (7) for securely holding the door (not shown) closed when the apparatus is in use.

The skilled person will be aware of a range of possible modifications of the various embodiments described above. Accordingly, the present invention is defined by the claims and their equivalents.

What is claimed is:

1. An apparatus for sanitizing objects comprising:

a body;

a hinge, a rear door, a clasp, a spool of tissue napkin, a nozzle, a slit and a dispensing bottle, wherein the body comprises an inner compartment surface, a rear compartment portion, a first aperture, a second aperture, and a third aperture, each aperture being on the inner compartment surface such that the second aperture is opposite of the third aperture along the rear compartment portion of said body, wherein the first aperture is adjacent to the second aperture along the rear compartment portion of said body, wherein a first rivet and a second rivet are inserted in the second aperture and the third aperture, respectively to receive the spool of tissue napkin, wherein the spool of tissue napkin extends through the slit to allow a user to dispense the tissue napkin for a use, wherein the nozzle is inserted through the first aperture.

2. The apparatus for sanitizing objects of claim 1 wherein said body is comprised of a front compartment portion.

3. The apparatus for sanitizing objects of claim 2 wherein said front compartment portion is adjoined to the rear compartment portion along one edge.

4. The apparatus for sanitizing objects of claim 2 wherein said rear compartment portion further includes a belt clip and said rear door.

5. The apparatus for sanitizing objects for claim 4 wherein said belt clip is coupled to said rear door.

6. The apparatus for sanitizing objects of claim 1 wherein said nozzle is along a top edge of said body.

7. The apparatus for sanitizing objects of claim 1 wherein said nozzle is attached to the top of said dispensing bottle.

8. The apparatus for sanitizing objects of claim 1 wherein said hinge is affixed to the rear compartment portion and said rear door in a manner to allow said rear door to pivot when being opened or closed.

9. The apparatus for sanitizing objects for claim 1 wherein said rear door is coupled to the rear compartment portion of said body.

10. The apparatus for sanitizing objects for claim 1 wherein said clasp is attached to the rear compartment portion along the center outer edge to couple with said rear door.

11. The apparatus for sanitizing objects for claim 1 wherein said spool of tissue napkin is rotatably attached to said second rivet and said first rivet.

12. The apparatus for sanitizing objects for claim 1 wherein said dispensing bottle is mounted to a clamp positioned in said rear compartment portion of said body.

* * * * *